US008358946B2

(12) United States Patent
Komiya

(10) Patent No.: US 8,358,946 B2
(45) Date of Patent: Jan. 22, 2013

(54) IMAGE FORMING APPARATUS

(75) Inventor: Yoshiyuki Komiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/776,684

(22) Filed: May 10, 2010

(65) Prior Publication Data

US 2010/0290799 A1 Nov. 18, 2010

(30) Foreign Application Priority Data

May 13, 2009 (JP) ..... 2009-116604

(51) Int. Cl.
*G03G 15/00* (2006.01)

(52) U.S. Cl. ..... 399/49; 399/72

(58) Field of Classification Search ..... 399/49, 399/72, 30, 27, 13, 38
See application file for complete search history.

(56) References Cited

U.S. PATENT DOCUMENTS

| | | | | |
|---|---|---|---|---|
| 4,994,854 | A | 2/1991 | Miyamoto | |
| 6,418,281 | B1 | 7/2002 | Ohki | |
| 2004/0085384 | A1 * | 5/2004 | Ju et al. | 347/19 |

* cited by examiner

*Primary Examiner* — Walter L Lindsay, Jr.
*Assistant Examiner* — Billy J Lactaoen
(74) *Attorney, Agent, or Firm* — Canon U.S.A., Inc. IP Division

(57) ABSTRACT

An image forming apparatus includes a first reading device which reads a reference image formed on a sheet, a second reading device which reads a reference image formed on an image carrier, a control device which can execute a first control process for adjusting image formation conditions based on a density of the reference image acquired from a read result of the first reading device, and a second control process for adjusting the image formation conditions based on a density of the reference image acquired from a read result of the second reading device, wherein the control device executes the second control process before performing image formation based on the image data when the first control process has not been executed in a period from when mounting of the unit configuring the image forming device is detected to when image formation is performed.

7 Claims, 8 Drawing Sheets

IMAGE FORMING APPARATUS

BACKGROUND OF THE INVENTION

1. Field of the Invention

The present invention relates to an electrophotographic image forming apparatus which can exchange components of an image forming unit thereof.

2. Description of the Related Art

A conventional electrophotographic image forming apparatus executes image formation using processes described below. Firstly a charging unit uniformly charges a photosensitive drum surface. Then an image processing unit converts image data in an original image (input image signal) based on a gamma look-up table (γLUT) configured to convert input image data stored in the image forming apparatus to thereby make density and gradation characteristics in the original image coincide with density gradation characteristics in an output image. A laser light source uses the converted image data to form an electrostatic latent image on the uniformly charged photosensitive drum surface. The developing unit develops the electrostatic latent image using a toner. The toner image on the photosensitive drum is transferred to a sheet and fixed, and then the image formation is completed. In the case of a color image forming apparatus, the above image forming process is executed for each color. A color image is formed by superimposing toner images for each color on an intermediate transfer member on a sheet during transfer processing.

Image formation characteristics including sensitivity of the photosensitive drum, charging characteristics and development characteristics in the above electrophotographic image forming apparatus are affected by variation in temperature or humidity or accumulate over a number of image forming sheets. Even when the image forming conditions such as charging bias, an exposure amount and developing bias are constant, a toner amount attached to the photosensitive drum may vary with variation in the temperature or humidity or accumulation of the number of image forming sheets. Such a problem occurs because the image forming conditions do not cope with the variation in the image forming characteristics.

To deal with such problem, U.S. Pat. No. 6,418,281 discusses an image density control method for adjusting an output image density by correcting a contrast potential and a γLUT according to variation of the image forming characteristics. The contrast potential means a potential difference between a potential of a developing device and a potential of an exposure unit on the photosensitive drum. A method for controlling image density is configured so that an image forming apparatus forms a patch (reference image) on a sheet to adjust a contrast potential when a user instructs an adjustment for the output image density. A user causes an image reading apparatus provided in the image forming apparatus to read the sheet. The image forming apparatus calculates a patch density using a result read by the image reading apparatus. The contrast potential is set using the difference between the patch density and a target density so that the patch is formed in the target density. Then a gradation test pattern formed from a plurality of patches is formed on the sheet based on the contrast potential set to correct gradation characteristics of the output image. The gradation test pattern is a pattern for generating the above described γLUT which is configured to convert input image data so that the gradation characteristics of the output image coincides with the gradation characteristics of the original image. The γLUT which is configured to convert input image data is generated so that the density of each patch in the gradation test pattern is formed at a target density (to coincide with the gradation characteristics assumed to be ideal for the output characteristics of the image forming apparatus). The input image data is subjected to data conversion according to the generated γLUT and forms as an image based on the converted data.

Since an image can be formed using a contrast potential and the γLUT which correspond to the image forming characteristics at different times by appropriately generating the γLUT or setting the contrast potential, the density and the gradation characteristics of the output image can closely approximate the original image. Image quality can be improved by adapting the γLUT or contrast potential settings to current environmental or apparatus characteristics. Thus, it is desirable to frequently execute control of image density and in particular, to perform image density control after exchanging a photosensitive drum, a charging unit, a developing unit, or the like during maintenance of the image forming apparatus.

However the following problem is associated with an image forming apparatus which can exchange a photosensitive drum, a charging unit, a developing unit, or the like during maintenance of the image forming apparatus. The image density control discussed in U.S. Pat. No. 6,418,281 is executed according to a user instruction and a user must perform an operation associated with reading a sheet on which a patch is formed into an image reading apparatus. As a result, when the user thinks such operation to be troublesome or does not have sufficient time to perform image density control, image formation is executed without γLUT generation or contrast potential settings adapted to the exchanged photosensitive drum, charging unit or developing unit. When the γLUT is not generated or setting for the contrast potential is not performed after exchanging of a photosensitive drum, a charging unit or a developing unit, a conventional image forming apparatus uses the γLUT or the contrast potential which was used for image formation before the component was exchanged. The γLUT or the contrast potential does not correspond to the image formation characteristics after exchange and therefore the problem has arisen that the density of an output image after exchange is different from the density of the original image.

In particular, an image forming apparatus configured to exchange a process cartridge which comprises a photosensitive drum, a charging unit and a developing unit integrated together as one unit and detachably attached to the image forming apparatus main body simultaneous exchanges the photosensitive drum, charging unit and developing unit. There is no guarantee that image density control is surely performed since exchange of the process cartridge of this type of image forming apparatus is executed by a general user rather than a highly skilled service personnel. Consequently, there is the risk that an image forming apparatus configured to exchange a process cartridge may cause a conspicuous deviation between the density and gradation characteristics in the output image and the density and gradation characteristics in the original image.

SUMMARY OF THE INVENTION

The present invention is directed to an image forming apparatus which automatically adjusts image forming conditions in an image forming device even when setting of a contrast potential setting and generation of γLUT are not performed based on a density detection result of a density patch formed on a sheet after exchange of a photosensitive drum, a charging unit or a developing unit.

According to an aspect of the present invention, an image forming apparatus includes an image forming device which includes an image carrier, a charging unit configured to charge the image carrier, an exposure unit configured to form an electrostatic latent image by exposing the image carrier charged by the charging unit based on image data, and a developing unit configured to develop the electrostatic latent image with a toner, and is configured to form a toner image on a sheet, a first reading device configured to read a reference image which is formed on a sheet by the image forming device, a second reading device configured to read a reference image formed on the image carrier by the image forming device, a control device which can execute a first control process for adjusting image formation conditions for the image forming device based on a density of the reference image acquired from a read result of the first reading device, and a second control process for adjusting the image formation conditions based on a density of the reference image acquired from a read result of the second reading device, and a mounting detection device configured to detect that a unit configuring the image forming device has been mounted, wherein the control device executes the second control process before performing image formation based on the image data when the first control process has not been executed in a period from when mounting of the unit configuring the image forming device is detected by the mounting detection device to when the image formation is performed based on the image data.

According to another aspect of the present invention, an image forming apparatus includes an image forming device which includes an image carrier, a charging unit configured to charge the image carrier, an exposure unit configured to form an electrostatic latent image by exposing the image carrier charged by the charging unit based on image data, and a developing unit configured to develop the electrostatic latent image with a toner, and is configured to form a toner image on a sheet, a first reading device configured to read a reference image which is formed on a sheet by the image forming device, a second reading device configured to read a reference image formed on the image carrier by the image forming device, a control device which can execute a first control process for adjusting image formation conditions for the image forming device based on a density of the reference image acquired from a read result of the first reading device, and a second control process for adjusting the image formation conditions based on a density of the reference image acquired from a read result of the second reading device, and a mounting detection device configured to detect that a unit configuring the image forming device has been mounted, wherein the control device executes the second control process in response to detection result from the mounting detection device that the unit configuring the image forming device has been mounted, and when the first control process has been executed in a period from detection of the mounting detection device that the unit configuring the image forming device has been mounted to execution of image formation based on the image data, the image formation is executed based on the image formation conditions adjusted according to the first control process, and when the first control process has not been executed in the period from the detection of the mounting detection to the execution of the image formation based on the image data, the image formation is executed based on the image formation conditions adjusted according to the second control process.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EXEMPLARY EMBODIMENTS

Various exemplary embodiments, features, and aspects of the invention will be described in detail below with reference to the drawings.

Figure 1:
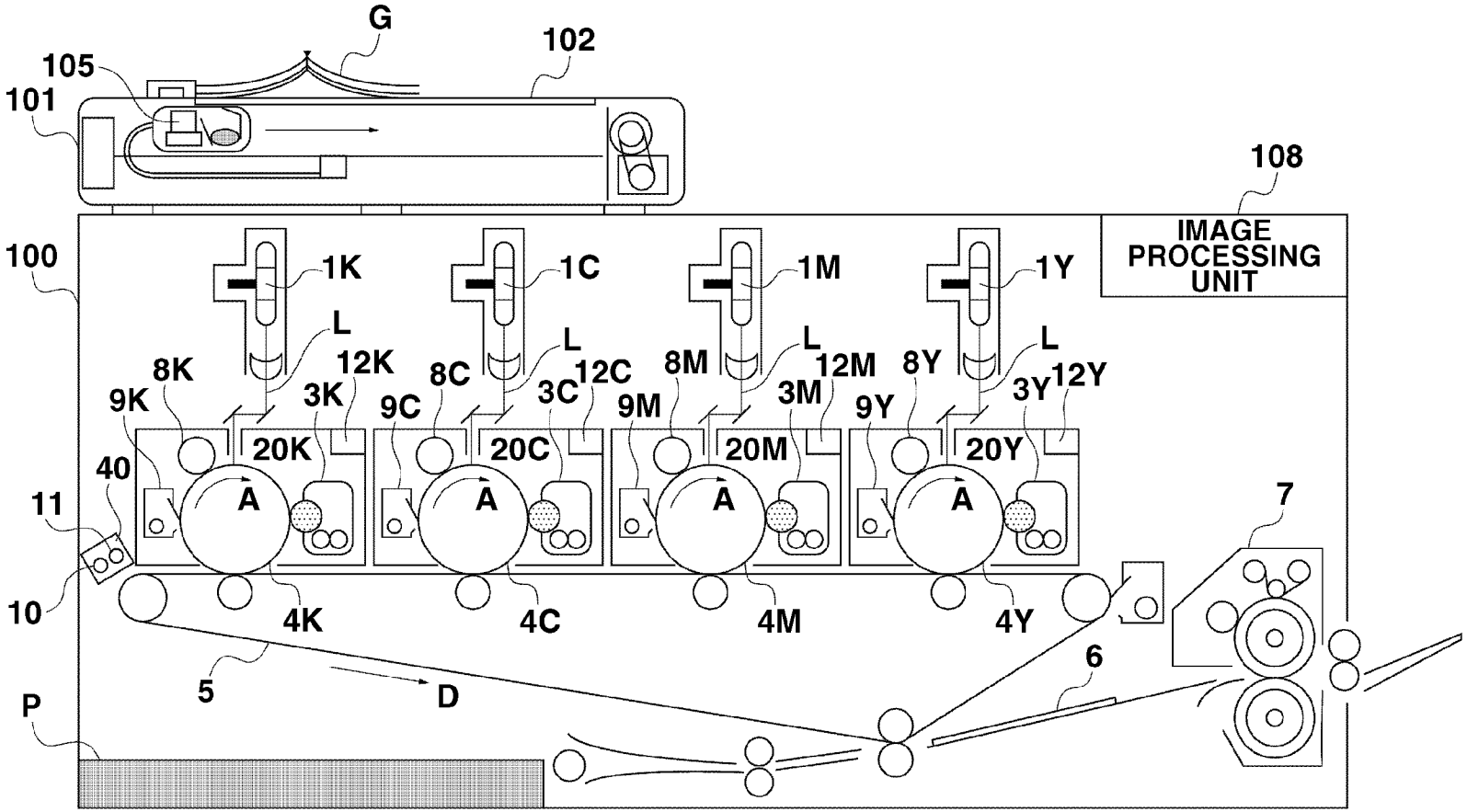
FIG. 1 is a schematic diagram of an image forming apparatus which includes an image reading apparatus according to a first exemplary embodiment and a second exemplary embodiment.

Firstly, an image forming apparatus and an image reading apparatus according to a first exemplary embodiment will be described using FIG. 1. FIG. 1 illustrates a sectional diagram of an image forming apparatus 100 and an image reading apparatus 101 according to the first exemplary embodiment.

The image reading apparatus 101 which acts as a first reading device will be described. A document G placed on a document positioning glass plate 102 is illuminated by a light source. The light reflected by the document G is formed as an image onto a charge-coupled device (CCD) 105 via an optical system such as an optical lens or a reflection mirror. The CCD 105 generates a red, green and blue component signal for each line sensor using red, green and blue CCD line sensor groups disposed in three rows. A reading optical device scans the document G placed on the document positioning glass plate 102 in a direction indicated by an arrow in FIG. 1 and converts the document into rows of electrical signal data according to each line. The image signal obtained by the CCD 105 is transmitted to an image processing unit 108 to execute image processing.

Next the image forming apparatus 100 will be described. Apparatuses and members that are denoted by the same reference numerals in an image station corresponding to yellow (Y), magenta (M), cyan (C) and black (Bk, hereafter K) execute the same function. The alphabets after the reference numerals denote that an apparatus corresponds to respective colors. To simplify the description below, the alphabet letters Y, M, C, and K expressing a color after a reference numeral are omitted as required. A plurality of toner colors including yellow (Y), magenta (M), cyan (C) and black (K) are used to form an image in the image forming apparatus illustrated in FIG. 1. The image forming apparatus 100 is a tandem type image forming apparatus which forms a toner image on a photosensitive drum 4 (4Y, 4M, 4C, 4K) and superimposes toner images of respective colors on a belt-type intermediate transfer member 5. The image forming apparatus according to the present exemplary embodiment includes an exposure unit 1 (1Y, 1M, 1C, 1K), a charging unit 8 (8Y, 8M, 8C, 8K) and a developing unit 3 (3Y, 3M, 3C, 3K). Further, the image forming apparatus 100 according to the present exemplary embodiment includes a mounting unit configured to mount a photosensitive drum 4 (4Y, 4M, 4C, 4K), a cleaning apparatus 9 (9Y, 9M, 9C, 9K) and a process cartridge 20 (20Y, 20M, 20C, 20K). The process cartridge 20 is an image forming device configured to integrate two or more of the charging unit 8, the developing unit 3, the photosensitive drum 4, and the cleaning apparatus 9. The charging unit 8 (8Y, 8M, 8C, 8K) is a roller charging device and applies a bias to uniformly charge a surface of the respective photosensitive drums 4 (4Y, 4M, 4C, 4K) to a negative polarity. When the toner stored in the respective color developing units 3 is completed consumed, a user exchanges a process cartridge 20 of the consumed color and can continue to perform image formation. An apparatus detection sensor 210 (210Y, 210M, 210C, 210K shown in FIG. 2) is mounted in proximity to the mounting unit and is configured to determine whether the respective process cartridges are mounted in the mounting unit.

The image forming process will be described below.

Input image data input from an information processing apparatus such as the image reading apparatus 101 or a computer to the image forming apparatus is subjected to image processing by the image processing unit 108. An exposure amount control unit 205 described below according to FIG. 2 causes a laser light source in the exposure unit 1 to emit light based on image data output from the image processing unit 108. The laser light emitted from the laser light source is deflected and scanned by a rotational polygon mirror (hereafter, polygon mirror) provided on the exposure unit 1 and passes through the optical system such as the optical lens and the reflection mirror to form an image on the photosensitive drum 4. The photosensitive drum 4 on which a latent image is formed by scanning the laser light rotates in the direction indicated by an arrow A in FIG. 1.

The surface of the rotating photosensitive drum 4 is uniformly charged by the charging unit 8 (for example, in the present exemplary embodiment, a charging potential of −500V). Then, exposure and scan of the photosensitive drum 4 is performed by the exposure unit 1 whose ON or OFF is controlled according to the input image data, so that a yellow electrostatic latent image which is a first color (the potential of the electrostatic latent image in the present exemplary embodiment is approximately −150V) is formed on the photosensitive drum 4Y of the process cartridge 20Y. The yellow electrostatic latent image is developed and visualized as an image by a yellow developing unit 3Y including a negative polarized yellow toner. A bias of −350V for example is applied to the toner as a developing bias by a developing sleeve (not illustrated) of the developing unit 3Y. A potential difference of 200V between the developing bias (−350V) and the potential (−150V) of the exposure unit at this time represents the contrast potential. Control of the contrast potential enables adjustment (control) of an attached amount of toner to the photosensitive drum, in other words, control of the image density.

A nip unit executes a primary transfer of the visualized toner image onto the intermediate transfer member 5 that is rotated in a direction indicated by an arrow D at a speed which is approximately equal to a circumferential speed of the photosensitive drum 4Y (in the present exemplary embodiment, 140 mm/s). Toner images of the other colors are transferred in a similar manner onto the intermediate transfer member 5 by respective nip units.

Toner remaining on the photosensitive drum 4 without being transferred to the intermediate transfer member 5 during the primary transfer process is removed by a cleaning blade provided on the cleaning apparatus 9 which is contacted with the photosensitive drum 4 by pressure.

Toner images of respective colors are sequentially transferred and superimposed onto the intermediate transfer member 5 from the photosensitive drum 4 of each process cartridge 20. Then, the toner images are secondary transferred all together onto a sheet 6 fed from a sheet feeding device P and is discharged from the apparatus via fixing processing by a fixing apparatus 7. Consequently, a full-color image is formed on the sheet 6.

Figure 2:
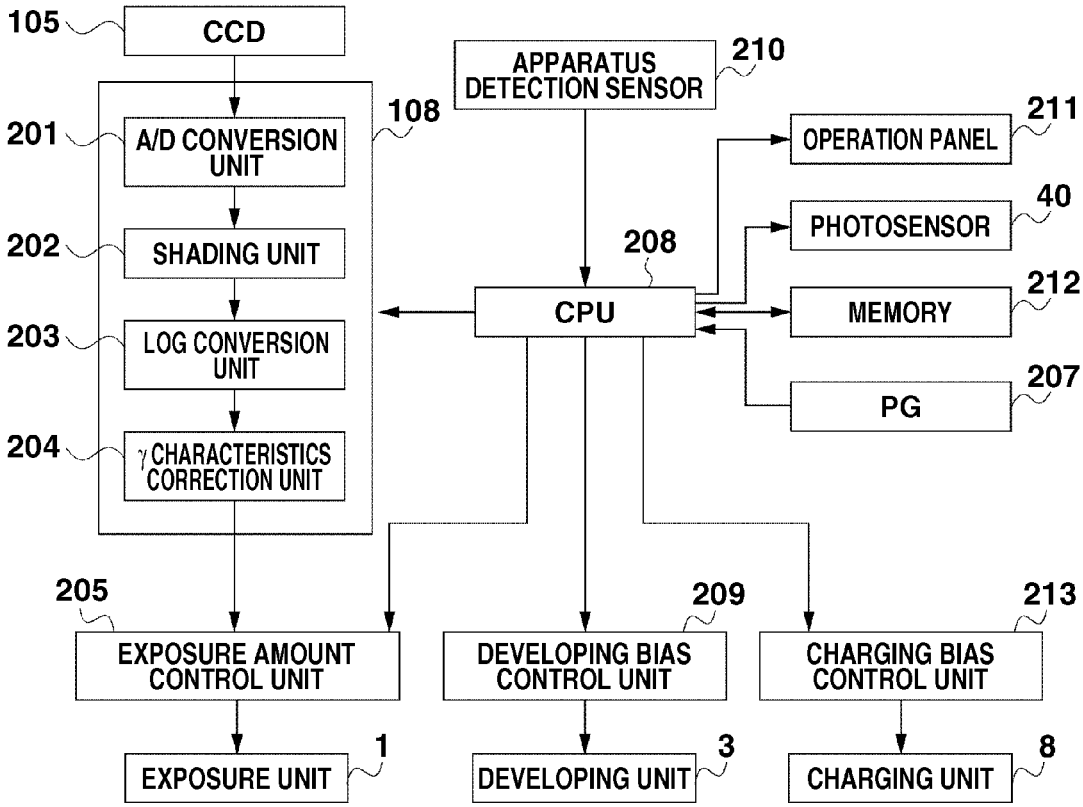
FIG. 2 is a block diagram of the image forming apparatus according to the first exemplary embodiment and the second exemplary embodiment.

FIG. 2 illustrates a block diagram of the image forming apparatus and the image reading apparatus provided in the image forming apparatus. A luminance signal of an original image read by the CCD 105 provided on the image reading apparatus 101 is input to the image processing unit 108. Firstly, the luminance signal is input to an analog-to-digital (A/D) conversion unit 201 of the image processing unit 108 and converted to a digital signal. The digital luminance signal is then transmitted to a shading unit 202 and shading correction is applied to correct unevenness of a light quantity caused by deviation in the sensitivity of each element of the CCD 105. The accuracy of image reading by the CCD 105 can be improved by the shading correction. The luminance signal corrected by the shading unit 202 is subjected to LOG conversion by a LOG correction unit 203. The LOG-converted signal is transmitted to a γ characteristic correction unit 203 and the image signal is converted by the γLUT which is generated so that density characteristics of an output image coincides with density characteristics which are ideal for the printer apparatus (it will be described in detail below). The converted image signal is transmitted to an exposure amount control unit 205. An exposure unit 1 (a laser light source, LED or the like) emits the light based on the image signal so that an electrostatic latent image is formed on the photosensitive drum 4.

A pattern generator 207 generates a patch image pattern signal to cause the image forming apparatus 100 to form a patch. The patch formed by the image forming apparatus 100 may be roughly classified into a pattern for setting a contrast potential (hereafter a density patch) and a pattern for correcting gradation characteristics (hereafter gradation test pattern).

A central processing unit (CPU) 208 is a control circuit configured to control the overall image forming apparatus 100. A memory 212 stores a control program configured to control various types of process executed by the image forming apparatus 100. The CPU 208 is connected to the exposure amount control unit 205, a photosensor 40, a developing bias control unit 209, the apparatus detection sensor 210 and a charge bias control unit 213. The control flow described below is executed by reading the control program stored in the memory 212. The developing bias control unit 209 and the charging bias control unit 213 control the developing bias and charging bias applied to the developing sleeve and the photosensitive drum by the developing unit 3 and the charging unit 8 provided in the process cartridge 20.

The apparatus detection sensor 210 detects whether the process cartridge 20 is mounted in a main body of the image forming apparatus. An operation panel 211 enables a user to input various instructions to the image forming apparatus 100.

Control for correcting density and gradation characteristics of an output image will be described below with reference to FIGS. 3A and 3B. A horizontal axis in FIG. 3A indicates an input image signal corresponding to the original image (input image data) and a vertical axis indicates an output image density. FIG. 3B illustrates a value of an output image signal corresponding to the value of an input image signal. A horizontal axis in FIG. 3B indicates an input image signal and a vertical axis indicates an output image signal.

Figure 3A:
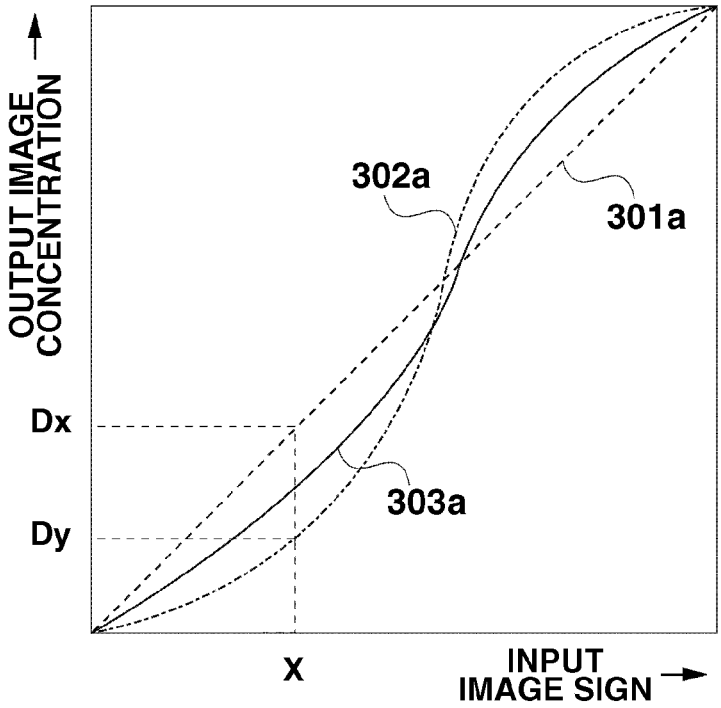
FIG. 3A illustrates a relationship between an input image signal and an output image density.
Figure 3B:
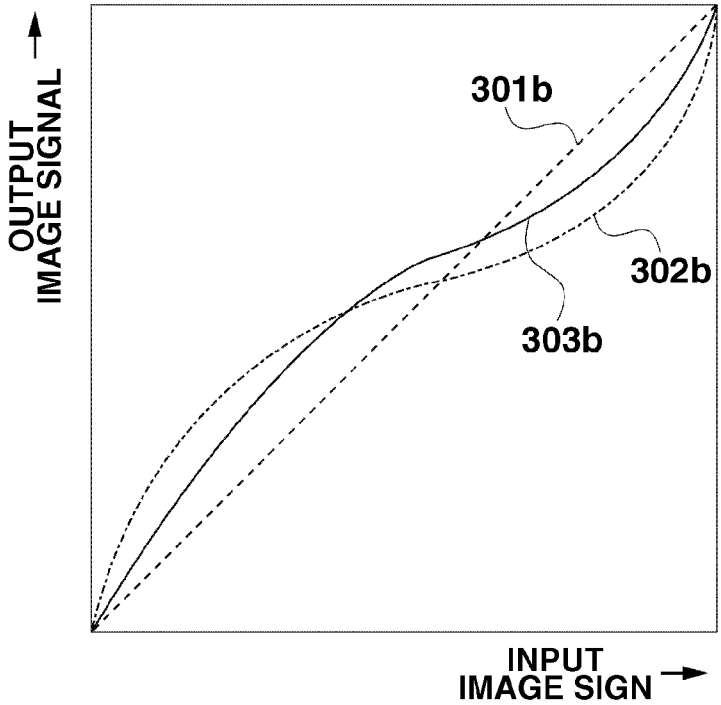
FIG. 3B illustrates a relationship between an input image signal and an output image signal.

A dotted line 301*a* (ideal gradation characteristics 310*a*) in FIG. 3A illustrates a case that density of an output image is ideally output with respect to an input image signal. The density of the output image takes a maximum value according to the maximum value of the input image signal. Since the input image signal displays a linear relationship (linear function) to the output image density, the gradation characteristics do not sharply vary. Thus profiles (pseudo-profiles) not in the original image are not generated and the output image has good gradation characteristics.

Gradation characteristics 302*a* indicate a correspondence relationship between the input image signal obtained from the density patch and the gradation test pattern formed on the sheet and the density of the output image. Gradation characteristics 303*a* indicate a correspondence relationship between the input image signal (image data) obtained from the density patch and the gradation test pattern formed on the intermediate transfer member 5 and the density of the output image.

In the electrophotographic image forming apparatus, when the input image signal is output without correction and an image is formed on the sheet, the image is formed in the gradation such as the gradation characteristics 302*a* illustrated in FIG. 3A. In other words, an image is output on the sheet at a density corresponding to the gradation characteristics 302*a* with respect to the input image signal. For example, when an image is formed by an input image signal X, the density of the image output on the sheet has Dy rather than the ideal density Dx.

In order to suppress such density deviation, the electrophotographic image forming apparatus corrects the input image signal based on correction data (conversion table) so that the ideal density Dx is obtained when the input image signal X is input to the γ characteristics correction unit 204.

A dotted line 301*b* in FIG. 3B illustrates a corresponding relationship between the input image signal and the output image signal when the input image signal is output without conversion. A γLUT 302*b* in FIG. 3B is a conversion table for converting the input image signal so that the image output to the sheet is output at an ideal density. The γLUT 302*b* is generated using the gradation characteristics 302*a* which result from detection of the patch density formed on the sheet. A γLUT 303*b* in FIG. 3B is a conversion table for converting the input image signal so that the image output to the intermediate transfer member is output at an ideal density. The γLUT 303*b* is generated from the detection result (the gradation characteristics 303*a*) for the patch density formed on the intermediate transfer member 5. One method for generating the γLUT 302*b* and the γLUT 303*b* is a method for performing reverse transformation on the gradation characteristics 302*a* and 303*a* with respect to a linear portion 301*b* corresponding to the ideal gradation characteristics 301*a*.

As described above, the γLUT 302*b* is generated based on the gradation characteristics 302*a* which are the density detection result of the density patch and the gradation test pattern formed on the sheet. The gradation characteristics 302*a* include effects on the image density such as conditions of the transfer apparatus or the fixing apparatus, and moisture contained in the sheet. Therefore, the γLUT 302*b* can convert the image signal for outputting the image at the density which is more suitable for environment and the apparatus than the γLUT 303*b*. Consequently, in order to closely approximate the image density and the gradation characteristics output from the image forming apparatus to the density and the gradation characteristics of the original image, it is desirable that the γLUT 302*b* is always set.

Although not illustrated, it is sometimes the case that the maximum value of the input image signal does not correspond with the maximum density of the output image. In that case, an image having a higher density or a lower density than a desired density may be output. In this case, the CPU 208 controls the contrast potential so that the density of the output image takes the maximum value when the maximum value of the input image signal is input.

The electrophotographic image forming apparatus 100 controls the contrast potential and corrects the input image signal as described above. However, the gradation characteristics and the output image density vary according to effects of environmental fluctuations (fluctuation in temperature and moisture) and the image formation characteristics of the apparatus at that time. Thus, the contrast potential and the γLUT are updated to correspond to the environmental fluctuations and the image formation characteristics of the apparatus at that time and control is performed so that an image can be output with the density and the gradation characteristics which are close to those of the original image.

A conventional image forming apparatus firstly controls a charging bias, a developing bias and an exposure amount so that an output image corresponding to the maximum input image signal is formed at a target density. The contrast potential which is the potential difference between the developing bias and the exposure unit potential is adjusted by adjusting the charging bias, the developing bias and the exposure amount. Then, a gradation test pattern is formed using the adjusted contrast potential, and the γLUT 302*b* for correcting the gradation characteristics of the output image is generated based on a detection result of the gradation test pattern (refer to FIG. 3B). The generated γLUT 302*b* is stored in the memory 212 and the input image signal is converted using the γLUT 302*b* by the γ characteristics correction unit 204. The laser light source of the exposure unit adjusts the light emission amount based on the image data converted by the γLUT 302*b*. Adjustment of the exposure amount includes adjustment by varying light intensity when exposure is performed to each pixel, or adjustment of a light exposure surface area per pixel by adjusting a pulse width of the signal causing light emission from the light source. Either adjustment method may be used for adjustment of image density.

Figure 4:
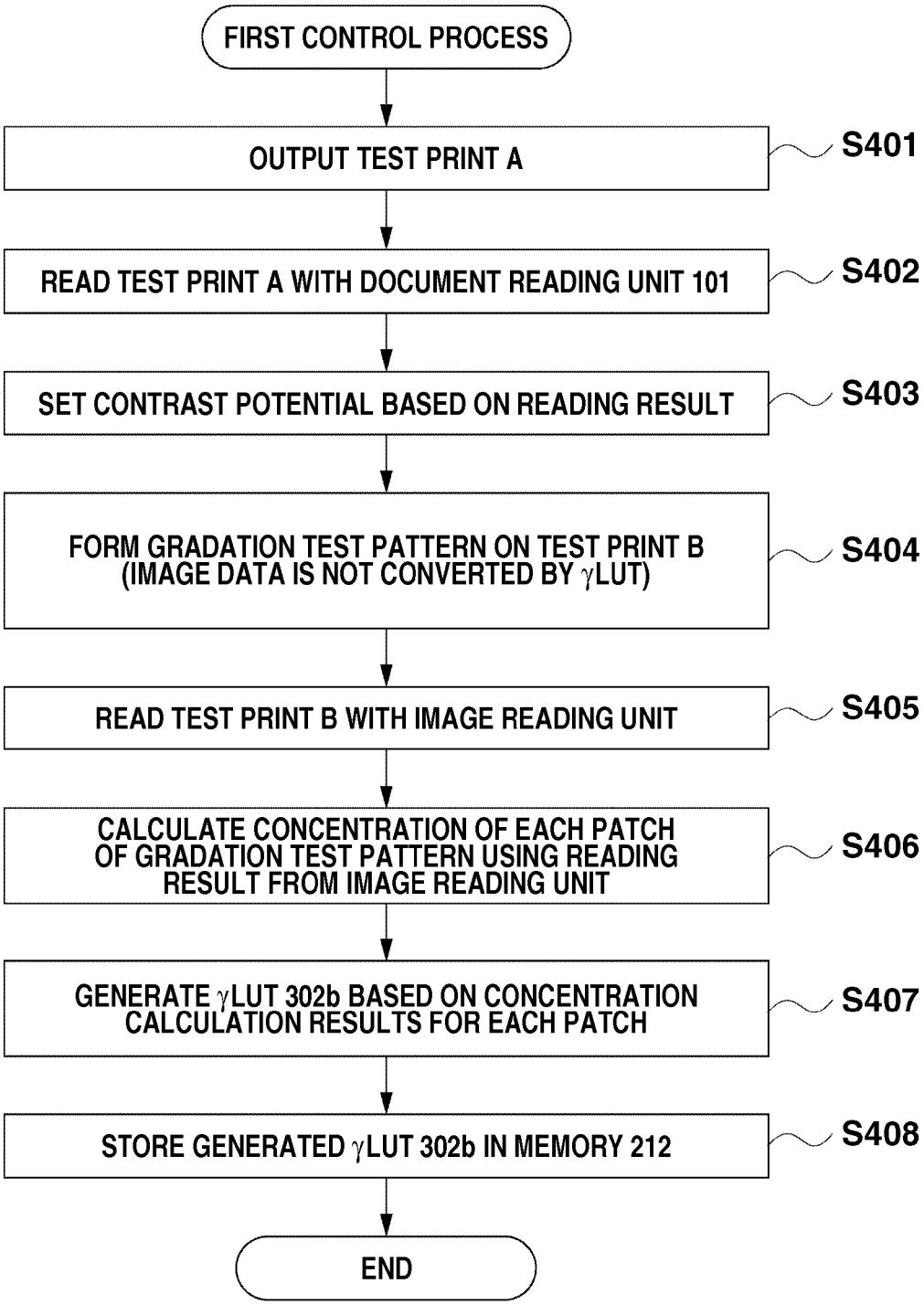
FIG. 4 is a flowchart illustrating first control processing according to the first exemplary embodiment.

An adjustment method of the contrast potential and a γLUT generation method will be described below in detail using the flowchart in FIG. 4. Image density control in the flowchart in FIG. 4 is referred to as a first control process. The first control process is started when a user inputs an instruction to a display unit. When the first control process is started, in step S401, the CPU 208 outputs a plurality of density patches to a test print A. At that time, the CPU 208 forms a plurality of density patches for adjusting the contrast potential on a sheet while varying at least one of the charging bias, the developing bias and the exposure amount. In step S402, the CPU 208 causes the image reading apparatus 101 to read the test print A placed on the document positioning plate of the image reading apparatus 101 by the user based on the user instruction input from the operation panel 211. Then in step S403, the CPU 208 compares each patch density calculated based on the reading result with the target density and sets the image forming conditions (charging device, developing device, and exposure amount) which form the density patch with the density which is close to that of the target density. According to the above described control, the contrast potential used in subsequent image formation steps can be adjusted.

Figure 5:
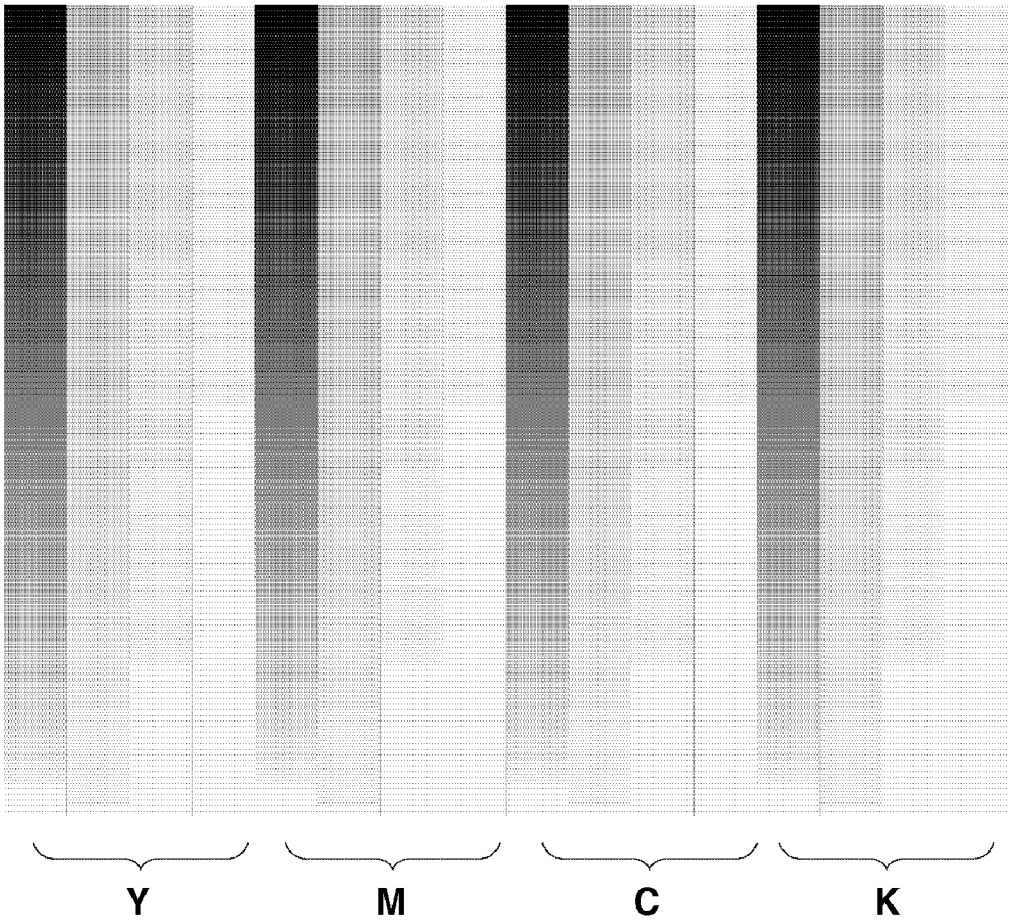
FIG. 5 illustrates a density patch and a gradation test pattern formed on a sheet.

Then the CPU 208 generates the γLUT 302*b* for controlling intermediate gradation. Firstly in step S404, the CPU 208 outputs a gradation test pattern for generating the γLUT 302*b* to a test print B. The gradation test pattern includes a plurality of patches corresponding to the set contrast potential (refer to FIG. 5). Then in step S405, the CPU 208 read the test print B located on the document positioning plate of the image reading apparatus 101 by the user based on the user instruction input from the operation panel 211. The image data is used for forming the gradation test pattern on the sheet. For example, the gradation test pattern formed on the sheet is configured with patches including 96 gradations for each color.

Then in step S406, the CPU 208 detects a density of each patch in the gradation test pattern based on the reading result by the image reading apparatus 101. In step S407, the CPU 208 generates the γLUT 302*b* based on the density detection result for each patch. At this time, the CPU 208 generates the γLUT 302*b* which is used for converting input image data (input image signal) to coincide with the target gradation characteristics 301*a* assumed to be ideal for the image forming apparatus. In step S408, the CPU 208 stores the generated γLUT 302*b* in the memory 212. The CPU 208 functions as a γLUT generation unit for generating the γLUT (conversion data) based on the density detection result. The γLUT 302*b* is used in conversion processing of subsequently input image data and the CPU 208 adjusts the light emission amount (exposure amount) of the exposure unit based on the converted image data. The CPU 208 also functions as a density adjustment unit for adjusting the image density by converting the image data based on the generated γLUT and adjusting the exposure amount exposed on the photosensitive drum. The γLUT in the present exemplary embodiment is a conversion table associating an image signal with an exposure amount.

Suitable generation of the γLUT 302*b* in this manner enables conversion of input image data using the γLUT corresponding to device characteristics and the environment at that time.

However, the image forming apparatus 100 which can execute the first control process causes the following problem when the process cartridge 20 is exchanged. Since the first control process is executed according to the operations and instructions of a user, there is no guarantee that all users will surely execute the first control process after exchanging the process cartridge 20. As a result, when the first control process has not been executed after exchange of the process cartridge 20, image formation is executed using the contrast potential or the γLUT before the exchange of the process cartridge 20. However, the states of the photosensitive drum 4, a developer, the charging unit 8, and the developing unit 3 are different in a new process cartridge and in a process cartridge that has been used for a long time. Consequently, when an image is formed after exchange of the process cartridge using the contrast potential or the γLUT before exchange of the process cartridge, the image density of each gradation is not output at a suitable value and the gradation characteristics of the image are deteriorated.

Therefore, when the first control process is not executed after the exchange of the process cartridge, the image forming apparatus 100 according to the present exemplary embodiment is configured to automatically form a gradation test pattern on the photosensitive drum 4 or the intermediate transfer member 5 to generate a density patch or the γLUT for adjusting the contrast potential. The image forming apparatus 100 according to the present exemplary embodiment is characterized by control for the adjustment of the contrast potential and the generation of the γLUT 303*b* based on the density detection results. This control is referred to as a second control process.

Figure 6A:
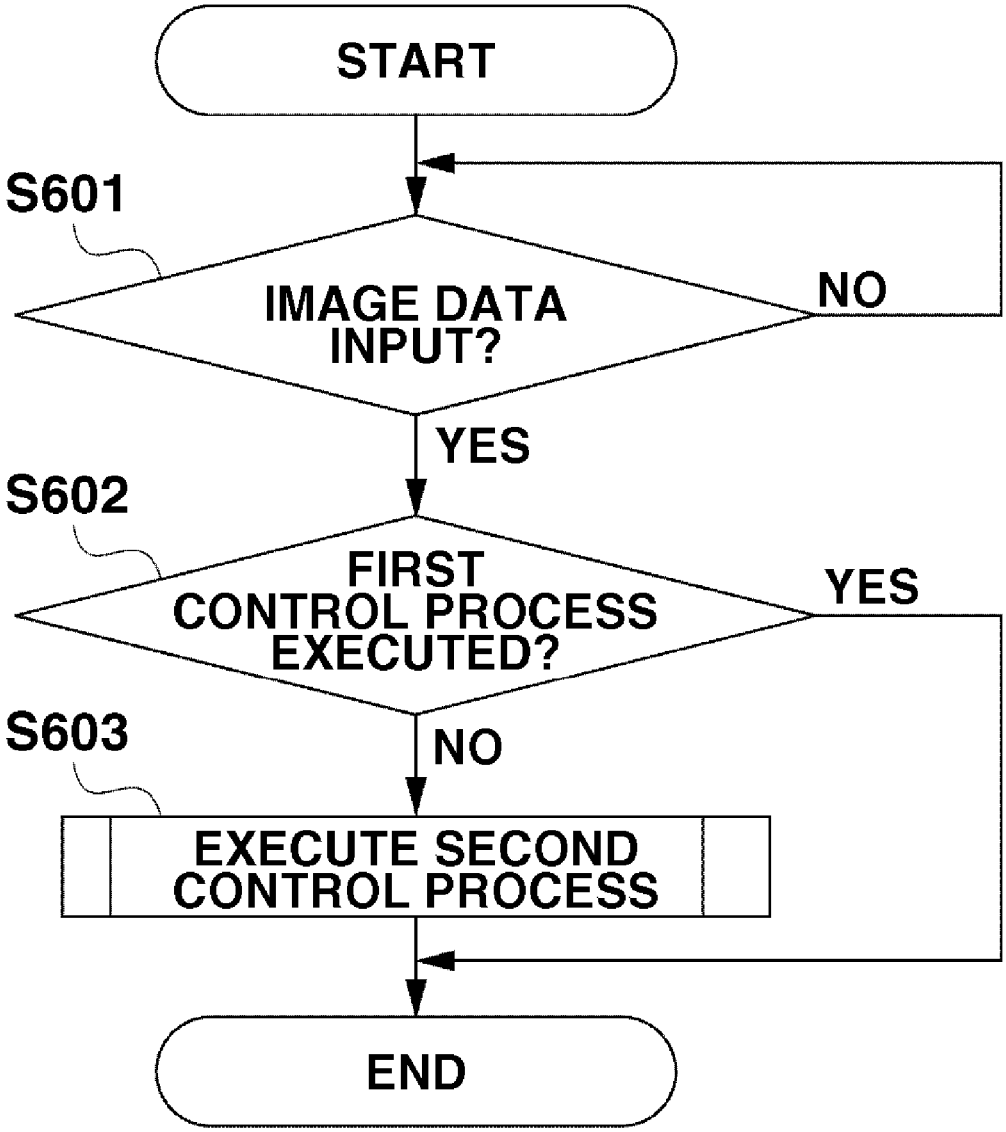
FIGS. 6A and 6B are flowcharts illustrating second control processing according to the first exemplary embodiment.
Figure 6B:
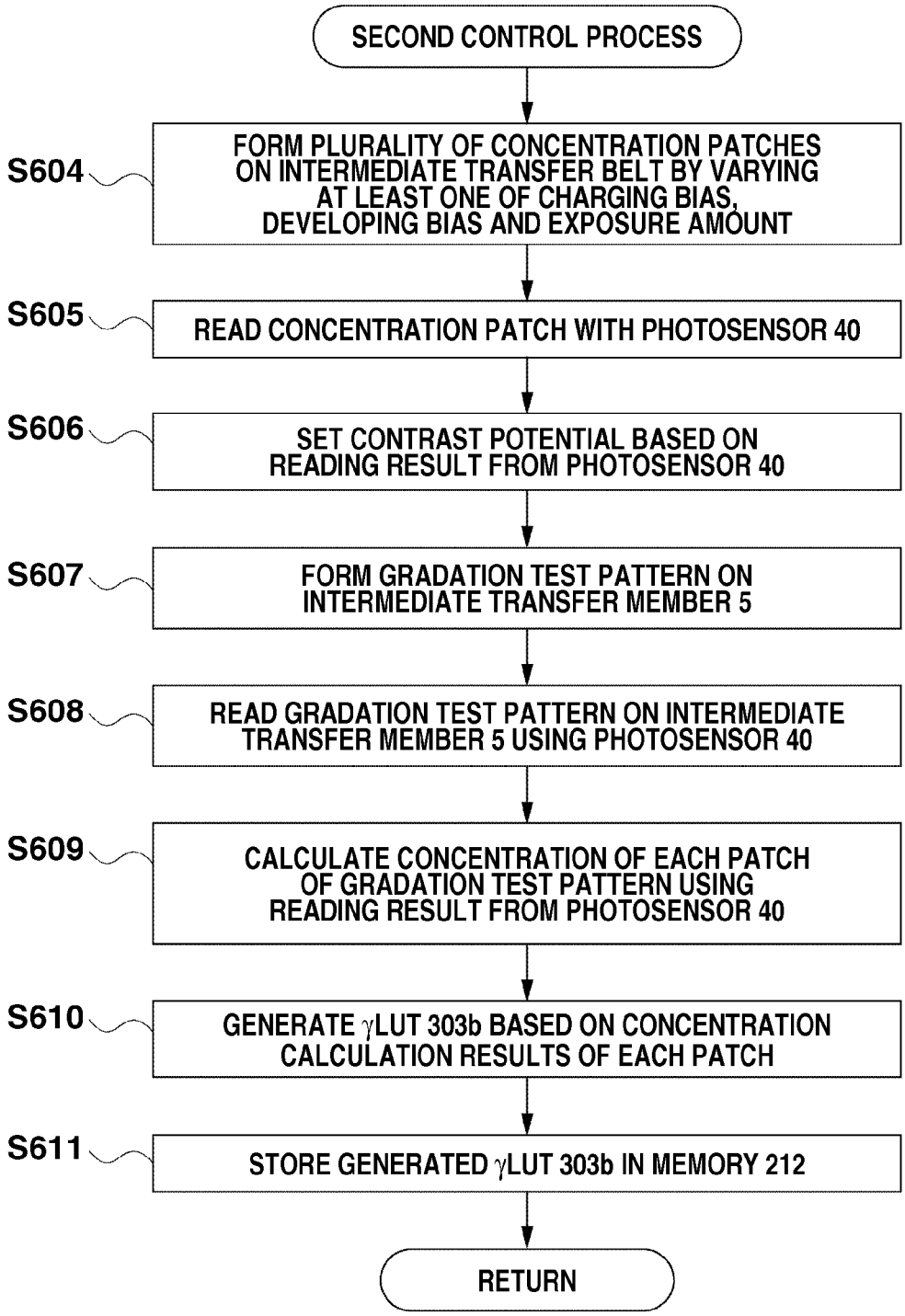

The characteristic portion of the second control process according to the present exemplary embodiment will be described below. The CPU 208 according to the present exemplary embodiment is a control device which can execute the first control process or the second control process. FIGS. 6A and 6B are flowcharts illustrating the control process executed by the CPU 208 of the image forming apparatus according to the present exemplary embodiment after exchange of a process cartridge. After the apparatus detection sensor 210 detects that the process cartridge 20 is mounted, in step S601, the CPU 208 determines whether image data is input from an external apparatus such as the image reading apparatus 101 or a PC. If it is determined that image data is input (YES in step S601), then in step S602, the CPU 208 determines whether the first control process is executed in a period from mounting of the process cartridge 20 to execution of image formation based on the image data. In other words, the CPU 208 determines whether setting for image forming conditions was executed based on the density patch and the gradation test pattern formed on the sheet. When it is determined that the first control process has not been executed (NO in step S602), then in step S603, the CPU 208 executes the second control process.

The second control process will be described below with reference to the flowchart in FIG. 6B. In step S604, the CPU 208 forms a plurality of density patches on the intermediate transfer member 5 based on the image pattern signal of the density patches generated by the pattern generator 207 while varying at least one of the charging bias, the developing bias and the exposure amount. Then in step S605, the CPU 208 causes the photosensor 40 provided to face the intermediate transfer member 5 to read the plurality of density patches formed on the intermediate transfer member 5. In step S606, the CPU 208 compares the density of each patch calculated based on the reading result and the target density and sets image forming conditions (the charging bias, developing bias and exposure amount) corresponding to the target density. The above described control process enables adjustment of the contrast potential.

Then the CPU 208 generates the γLUT 303*b* for controlling intermediate gradation. In step S607, the CPU 208 forms a gradation test pattern formed from a plurality of patches each of which has a different density on the intermediate transfer member 5 using the contrast potential set in step S606 based on the image pattern signal of the patch generated by the pattern generator 207. The gradation test pattern is used for detecting the gradation characteristics 303*a* of the image forming apparatus. Therefore, the image data at that time is not converted using the γLUT 302*b* which is stored in the memory 212 before the exchange of the process cartridge 20. In the present exemplary embodiment, each of the plurality of patches is formed based on the image data corresponding to a density level of 16, 32, 64, 92, 128, 160, 192, and 255 in a density region expressed by a value 0 to 255 (8 bits).

In step S608, the CPU 208 causes the photosensor 40 to read the gradation test pattern formed on the intermediate transfer member 5. Then in step S609, a density of each gradation patch of the gradation test pattern is calculated based on the results read by the photosensor 40. When the image forming apparatus 100 is in an ideal state, the density of each patch may be detected at a density corresponding to the image data of the density level of 16, 32, 64, 92, 128, 192 and 255. However, each patch is not formed at a density corresponding to the image data due to various characteristics of the image forming apparatus 100.

As described above, since a difference is generated between a desired image density and an actual formed image density, the following control process is executed to correct the density difference. In step S610, the CPU 208 acquires the difference of density between the image data for each gradation and the gradation test pattern and generates the γLUT 303*b* so that the gradation test pattern is output at an ideal image density. Then in step S611, the CPU 208 stores the generated γLUT 303*b* in the memory 212.

When the first control process is executed before the input of the image data in step S602, the γLUT 302*b* generated in the first control process is already stored in the memory 212. Consequently, the second control process is not performed and the input image data is converted by the γLUT 302*b* generated in the first control process to execute image formation.

The CCD 105 and the photosensor 40 provided in the document reading apparatus are denoted respectively as a first reading unit and a second reading unit according to the present exemplary embodiment.

In the present exemplary embodiment, an example has been described in which a density patch and a gradation test pattern for each color are formed on the intermediate transfer member 5 after exchanging the process cartridge 20. However, if image density control for all colors is executed when a process cartridge is exchanged only for one color, the consumption amount of toner or time required for control operations will be increased. Thus the image forming apparatus 100 according to the present exemplary embodiment may be adapted so that a density patch and a gradation test pattern for only the color corresponding to the exchanged process cartridge 20 is formed on the intermediate transfer member 5. In this manner, the toner consumption amount can be suppressed since toner patterns are not formed in colors for process cartridges which have not been exchanged.

In the present exemplary embodiment, an example has been described in which a plurality of density patches is formed by differentiating image formation conditions to set a contrast potential in the second control process. However, the contrast potential set before exchange of the process cartridge may continue to be used and only a gradation test pattern may be formed. This is because the fluctuation in the contrast potential is not very large. In this case, since a density patch for setting the contrast potential is not formed, the time required for density control operations can be reduced.

In the present exemplary embodiment, although image density control performed when a component used in image formation is exchanged has been described using the example of the process cartridge, the present exemplary embodiment is not limited in this regard. For example, the above control may be applied to an image forming apparatus 100 which individually exchanges a photosensitive drum, a charging unit or a developing unit. In this apparatus, a mounting detector sensor is provided in at least one of each mounting unit for the photosensitive drum, the charging unit, and the developing unit. The control method is as described above.

In the present exemplary embodiment, the CPU 208 is configured to determine whether the image data is input in step S601. However the CPU 208 may be configured to determine whether timing has been reached at which image data is input and image formation based on the image data is executed.

Although the first exemplary embodiment has been described with a configuration in which toner images formed on a plurality of photosensitive drums 4 are transferred to the intermediate transfer member 5, the configuration of the image forming apparatus 100 is not limited in this regard. For example, the image forming apparatus may be configured to sequentially form a toner image of a plurality of colors on a single photosensitive drum and superimpose toner of each color on the intermediate transfer member.

The first exemplary embodiment is described using an example in which a density patch and a gradation pattern are formed on the intermediate transfer member 5 when the first control process has not been performed in the period from exchange of the process cartridge to a start of image formation. In a second exemplary embodiment, a method will be described in which contrast potential settings and γLUT generation are performed after exchange of the process cartridge by control which differs from that of the first exemplary embodiment. In the present exemplary embodiment, description of aspects which are the same as those in the first exemplary embodiment will not be repeated.

In the present exemplary embodiment, the CPU 208 executes the second control process according to whether a process cartridge 20 is mounted. When the first control process is not performed in the period from mounting of the process cartridge 20 to the start of image formation based on the input image data, the subsequent image formation is performed using the contrast potential and the γLUT 303*b* adjusted by the second control process. When the first control process is performed in the period from mounting of the process cartridge 20 to the start of image formation based on the input image data, the contrast potential and the γLUT 302*b* adjusted by the first control process are used for the subsequent image formation.

Figure 7:
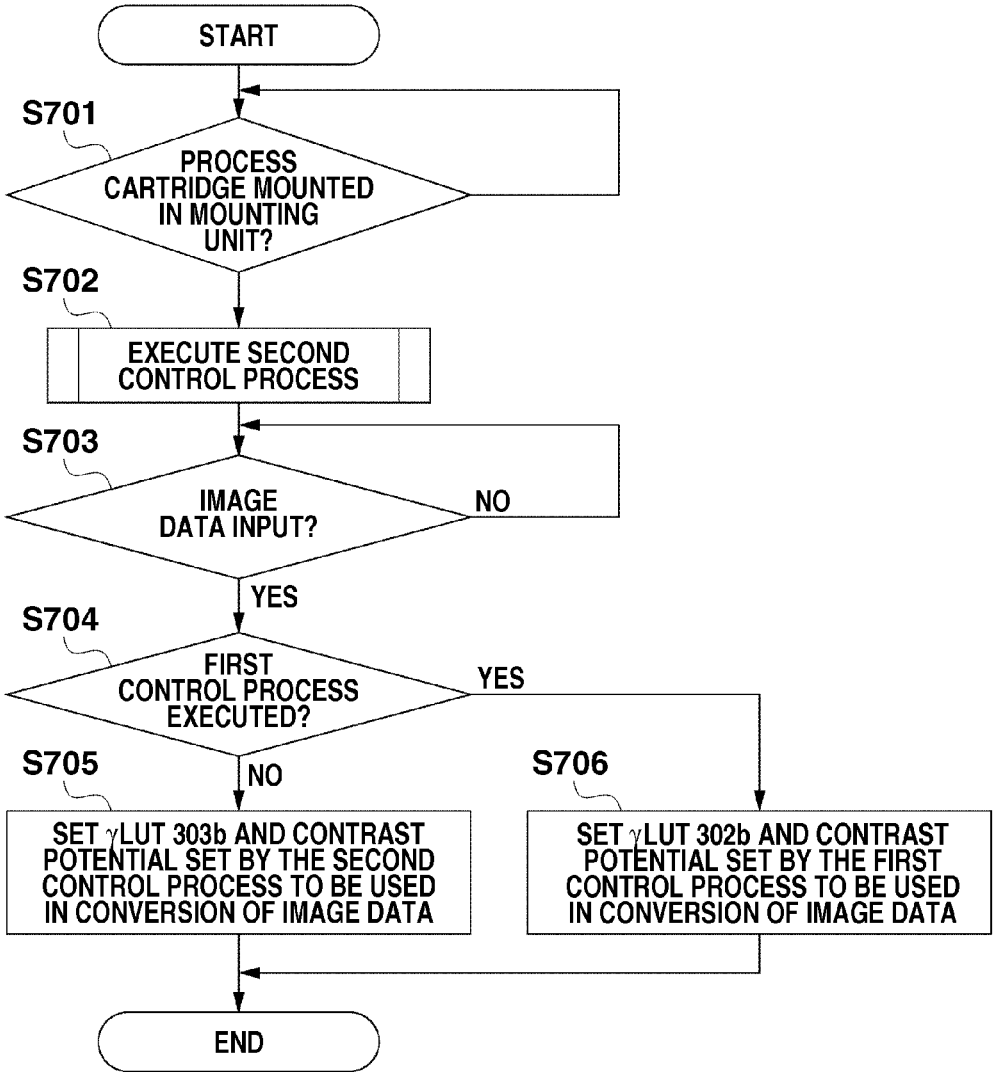
FIG. 7 is a flowchart illustrating control during exchange of a process cartridge according to the second exemplary embodiment.

FIG. 7 is a flowchart illustrating control during exchange of a process cartridge 20 according to the second exemplary embodiment. In step S701, the CPU 208 determines whether the process cartridge 20 is mounted. If the CPU 208 determines that the process cartridge 20 is mounted (YES in step S701), then in step S702, the CPU executes the second control process. The second control process is the same as the process illustrated in FIG. 6B and therefore description will not be repeated.

Then in step S703, the CPU 208 determines whether the image data for forming an image on the sheet has been input to the image forming apparatus. When it is determined that the image data has been input (YES in step S703), then in step S704, the CPU 208 determines whether the first control process was executed after mounting the process cartridge 20. If it is determined that the first control process was not executed (NO in step S704), then in step S705, the CPU 208 sets the contrast potential and the γLUT 303*b* set in the second control process as the image forming conditions for the subsequent image formation.

On the other hand, if it is determined that the first control process was executed in the period from mounting of the process cartridge 20 to input of the image data (YES in step S704), the γLUT 302*b* is generated. In this case, the processing proceeds to step S706, and the CPU 208 sets the contrast potential and the γLUT 302*b* set in the first control process as the image forming conditions for the subsequent image formation. The input image data is converted by the γLUT 302*b* during the subsequent image formation.

According to the above described control, an image can be provided which has stable gradation and is not affected by variation in output characteristics of the image forming apparatus 100 before and after exchange of the process cartridge 20.

Further, in the control executed in the first exemplary embodiment, when the γLUT 302*b* by the first control process is not generated in the period from exchange of the process cartridge 20 to formation of an image based on the image data, the density patch and the gradation test pattern are formed on the intermediate transfer member 5. Then the γLUT 303*b* is generated based on density information in the density patch and the gradation test pattern on the intermediate transfer member 5. In the control executed in the first exemplary embodiment, since the density patch and the gradation test pattern are formed on the intermediate transfer member 5 after input of the image data, time is required from input of the image data until the image data is actually output on the sheet. However, in the control process according to the second exemplary embodiment, since the γLUT 303*b* is already stored in the memory 212 when the image data is input, downtime caused after input of image data can be reduced in comparison to the first exemplary embodiment even when the first control process is not executed after exchange of the process cartridge.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-116604 filed May 13, 2009, which is hereby incorporated by reference herein in its entirety.

What is claimed is:

1. An image forming apparatus comprising:

an image forming device which includes an image carrier, a charging unit configured to charge the image carrier, an exposure unit configured to form an electrostatic latent image by exposing the image carrier charged by the charging unit based on image data, a developing unit configured to develop the electrostatic latent image with a toner, and an intermediate transfer member on which a toner image developed by the developing unit is transferred, and is configured to transfer the toner image on a sheet;

a first reading device configured to read a reference image which is formed on a sheet by the image forming device;

a second reading device configured to read a reference image formed on the intermediate transfer member by the image forming device;

a control device which can execute a first control process for adjusting image formation conditions for the image forming device based on a density of the reference image acquired from a read result of the first reading device, and a second control process for adjusting the image formation conditions based on a density of the reference image acquired from a read result of the second reading device; and a mounting detection device configured to detect that a unit configuring the image forming device has been mounted, wherein the control device executes the second control process before performing image formation based on the image data when the first control process has not been executed in a period from when mounting of the unit configuring the image forming device is detected by the mounting detection device to when the image formation is performed based on the image data.

2. The image forming apparatus according to claim 1, wherein the image forming device executes image formation using a plurality of toner colors, and when the unit configuring the image forming device is mounted, the control device executes the second control process with respect to a color corresponding to the unit of which mounting is detected by the mounting detection device, and does not execute the second control process with respect to a color corresponding to the unit of which is not detected by the mounting detection device.

3. The image forming apparatus according to claim 1, wherein the control device controls a bias control device configured to control a potential difference between a potential of the electrostatic latent image and a developing bias applied by the developing unit to toner.

4. The image forming apparatus according to claim 1, wherein the control device controls an exposure amount control device configured to control an exposure amount of light shed onto the image carrier by the exposure unit.

5. The image forming apparatus according to claim 4, wherein the control device generates conversion data for converting the image data based on a density detection result of the reference image on the intermediate transfer member, and the exposure amount control device adjusts the exposure amount by converting the image data based on the conversion data.

6. The image forming apparatus according to claim 1, wherein the image forming device is a process cartridge into which the image carrier, the charging unit and the developing unit are integrated, and the mounting detection device detects that the process cartridge is mounted in the image forming apparatus.

7. An image forming apparatus comprising:

an image forming device which includes an image carrier, a charging unit configured to charge the image carrier, an exposure unit configured to form an electrostatic latent image by exposing the image carrier charged by the charging unit based on image data, a developing unit configured to develop the electrostatic latent image with a toner, and an intermediate transfer member on which a toner image developed by the developing unit is transferred, and is configured to transfer the toner image on a sheet;

a first reading device configured to read a reference image which is formed on a sheet by the image forming device;

a second reading device configured to read a reference image formed on the intermediate transfer member by the image forming device;

a control device which can execute a first control process for adjusting image formation conditions for the image forming device based on a density of the reference image acquired from a read result of the first reading device, and a second control process for adjusting the image formation conditions based on a density of the reference image acquired from a read result of the second reading device; and amounting detection device configured to detect that a unit configuring the image forming device has been mounted, wherein the control device executes the second control process in response to detection result from the mounting detection device that the unit configuring the image forming device has been mounted, and when the first control process has been executed in a period from detection of the mounting detection device that the unit configuring the image forming device has been mounted to execution of image formation based on the image data, the image formation is executed based on the image formation conditions adjusted according to the first control process, and when the first control process has not been executed in the period from the detection of the mounting detection to the execution of the image formation based on the image data, the image formation is executed based on the image formation conditions adjusted according to the second control process.

* * * * *